US006824458B2

(12) United States Patent
Ensinger

(10) Patent No.: US 6,824,458 B2
(45) Date of Patent: Nov. 30, 2004

(54) RETAINING RING FOR HOLDING SEMICONDUCTOR WAFERS IN A CHEMICAL MECHANICAL POLISHING APPARATUS

(75) Inventor: Wilfried Ensinger, Nufringen (DE)

(73) Assignee: Ensinger Kunststofftechnologie GBR, Nufringen (DE)

( * ) Notice: Subject to any disclaimer, the term of this patent is extended or adjusted under 35 U.S.C. 154(b) by 0 days.

(21) Appl. No.: 10/322,428

(22) Filed: Dec. 19, 2002

(65) Prior Publication Data

US 2004/0067723 A1 Apr. 8, 2004

(30) Foreign Application Priority Data

Oct. 2, 2002 (DE) ..... 102 47 180

(51) Int. Cl.[7] ..... B24B 7/07

(52) U.S. Cl. ..... 451/415; 451/398; 451/397; 451/288

(58) Field of Search ..... 451/415, 398, 451/397, 285–288, 41, 8, 526, 490

(56) References Cited

U.S. PATENT DOCUMENTS

| | | | | |
|---|---|---|---|---|
| 4,212,137 A | * | 7/1980 | Rue | 451/542 |
| 5,643,061 A | | 7/1997 | Jackson et al. | |
| 5,695,392 A | | 12/1997 | Kim | |
| 5,993,302 A | | 11/1999 | Chen et al. | |
| 6,030,280 A | | 2/2000 | Fruitman | |
| 6,068,548 A | | 5/2000 | Vote et al. | |
| 6,186,880 B1 | | 2/2001 | Gonzalez et al. | |
| 6,251,215 B1 | | 6/2001 | Zuniga et al. | |
| 6,264,540 B1 | | 7/2001 | Fruitman | |
| 6,277,008 B1 | | 8/2001 | Masuta et al. | |
| 6,354,927 B1 | * | 3/2002 | Natalicio | 451/287 |
| 6,390,904 B1 | | 5/2002 | Gleason et al. | |
| 6,390,908 B1 | * | 5/2002 | Chen et al. | 451/398 |
| 6,439,984 B1 | | 8/2002 | Andres | |
| 6,471,566 B1 | * | 10/2002 | Mikhaylich et al. | 451/41 |
| 6,585,850 B1 | | 7/2003 | Kenji et al. | |
| 2002/0049030 A1 | | 4/2002 | Numoto et al. | |

FOREIGN PATENT DOCUMENTS

| | | |
|---|---|---|
| DE | 198227308 | 12/1999 |
| EP | 0 747 167 | 12/1996 |
| EP | 0 841 123 | 11/1997 |

OTHER PUBLICATIONS

U.S. patent application Ser. No. 10/322,427, Ensinger, filed Dec. 19, 2002.

* cited by examiner

*Primary Examiner*—Lee D. Wilson
(74) *Attorney, Agent, or Firm*—Leydig, Voit & Mayer, Ltd.

(57) ABSTRACT

A retaining ring to be fitted on a chemical mechanical polishing apparatus for semiconductor wafers is disclosed, the retaining ring being of integral design made of a plastic material, wherein the retaining ring forms on a first front side thereof a bearing surface for supporting the retaining ring on a polishing surface of the polishing apparatus, and includes on the side thereof lying opposite the first front side thereof in axial direction fitting elements for fitting the retaining ring on the polishing apparatus.

22 Claims, 5 Drawing Sheets

RETAINING RING FOR HOLDING SEMICONDUCTOR WAFERS IN A CHEMICAL MECHANICAL POLISHING APPARATUS

CROSS-REFERENCE TO RELATED PATENT APPLICATIONS

This patent application claims the benefit of German Patent Application No. 102 47 180.0, filed Oct. 2, 2002, which is incorporated by reference.

FIELD OF THE INVENTION

The invention relates to a retaining ring for holding semiconductor wafers in a chemical mechanical polishing apparatus.

BACKGROUND OF THE INVENTION

Nowadays, integrated circuits are typically formed on semiconductor substrates, particularly silicon wafers, by the sequential deposition of conductive, semiconductive and insulative layers on the wafer. After deposition of each layer, etching is performed to create the circuitry functions. After a series of layers have been sequentially deposited and etched, the uppermost surface of the semiconductor substrate, i.e., the outer surface of the substrate, becomes increasingly non-planar. This non-planar surface presents problems in the photolithographic steps of the integrated circuit fabrication process. Therefore, there is a need to periodically planarize or level off the semiconductor substrate surface.

So-called chemical mechanical polishing (CMP) is one of the accepted methods for this. This planarization method typically requires that the substrate, i.e., the semiconductor wafer, be mounted on a carrier or polishing head. The exposed surface of the substrate is then pressed against a rotating polishing pad. A controlled force is exerted on the substrate via the carrier head to press the substrate against the polishing pad. A polishing agent containing at least one chemically reactive substance and abrasive particles is supplied to the surface of the polishing pad.

A recurring problem in the CMP process is the so-called edge effect, i.e., the tendency to polish the edge of the substrate at a different rate than the center of the substrate. This typically results in over-polishing at the edge, i.e., the removal of too much material from the edge, particularly at the outermost 5 to 10 mm of a wafer of 200 mm in diameter.

Over-polishing reduces the overall flatness of the substrate and makes the edge of the substrate unsuitable for integrated circuit fabrication and therefore decreases the process yield.

To solve this problem, U.S. Pat. No. 6,251,215 discloses a retaining ring be made of two portions, a first portion being made of a rigid material, namely a metal portion, and a second portion of a plastic material, which is less rigid, so that, on the one hand, it can be subjected to abrasion, and, on the other hand, it will not damage the semiconductor wafer when contacting it.

Owing to the edge conditions that prevail in chemical mechanical polishing, U.S. Pat. No. 6,251,215 discloses that the plastic portion of the retaining ring and the metal ring are bonded to one another with an epoxy adhesive. Alternatively, it is disclosed that the two portions are joined together with a press fit.

In practice, both solutions prove to be inadequate.

While the plastic portion is held securely on the metal portion when the two portions are bonded with epoxy adhesive, the reconditioning of the retaining ring after the plastic portion has been subjected to a certain amount of abrasion presents problems. The current practice is to send the complete retaining rings to the manufacturer where the plastic portion is mechanically removed and the metal portion is then heated up to approximately 200° C. to thermally decompose the adhesive residues thereon. Subsequently, the metal portion has to be sandblasted in order to remove final residues of the adhesive, and only then can a new plastic ring be adhesively attached thereto.

Owing to this time-consuming and costly procedure, the retaining rings as such become very expensive. In addition, the metal portions, which are more expensive to produce than the plastic portions, only withstand a small number of cycles of reconditioning, in particular, on account of the temperature treatment for thermal decomposition of the adhesive and the sandblasting treatment that is subsequently required.

Exchanging a used plastic ring when metal and plastic portions are joined with a press fit is easier, but a press fit for joining the plastic and metal portions has proven unsuitable for reliably withstanding the forces that occur during the polishing process.

The present invention, relating to a retaining ring that can be manufactured more cost-effectively and, in particular, fitted more cost-effectively with a new plastic part, provides for ameliorating at least some of the disadvantages of the prior art. These and other advantages of the present invention will be apparent from the description as set forth below.

BRIEF SUMMARY OF THE INVENTION

In an embodiment, the invention provides a retaining ring, wherein the retaining ring is of integral design and is made of a plastic material, and the retaining ring forms on a first front side thereof a bearing surface for supporting the retaining ring on a polishing surface of the polishing apparatus, and includes on the side thereof lying opposite the first front side thereof in axial direction fitting elements for fitting the retaining ring on the polishing apparatus.

DETAILED DESCRIPTION OF THE INVENTION

Figure 1B:
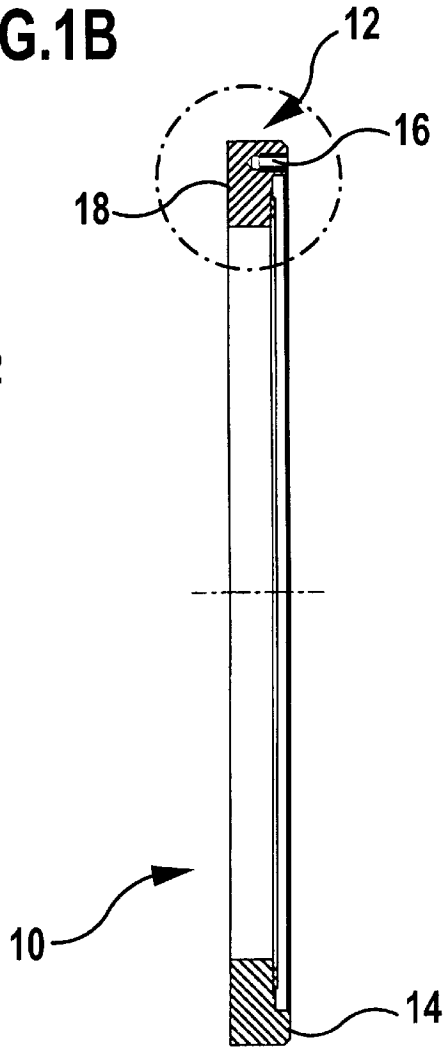
FIGS. 1A to 1D show a first embodiment of a retaining ring according to the invention.

In accordance with an embodiment of the present invention, a retaining ring is provided, the retaining ring being of integral design and made of a plastic material, the retaining ring forming on a first front side thereof a bearing surface for supporting the retaining ring on a polishing surface of the polishing apparatus, and including on the side thereof lying opposite the first front side thereof in axial direction fitting elements for fitting the retaining ring on the polishing apparatus.

The inventive construction of the retaining ring permits cost-effective manufacture thereof, and the retaining ring can, therefore, be disposed of in its entirety after excessive wear.

In order to impart sufficient stability to the retaining ring, which ensures that the retaining ring will not undergo deformation in its geometry during the polishing process and thereby cause uneven removal of material from the semiconductor wafer, the plastic material is selected on the basis of its mechanical properties.

The retaining ring is preferably made up like a sandwich of at least two layers or components.

The plastic material may, for example, include a thermoplastic material, a thermosetting plastic material, an elastomer and/or a plastic composition.

A considerably larger range of plastic materials is available when the plastic material is used in reinforced, in particular in fiber-reinforced, form.

It is then desirable for the plastic material to exhibit adjacent to its first front side, i.e., the side forming the bearing surface for supporting the retaining ring on a polishing surface of the polishing apparatus, no reinforcement materials or a lower content of reinforcement materials than on its side including the fitting elements.

This results in a partial area of increased mechanical stability, which stabilizes the retaining ring overall in its geometry, in the area held on the polishing apparatus. On the side on which the abrasive wear occurs, the retaining ring then exhibits lower stability and, in particular, is less hard, so that contact between the semiconductor wafers to be treated and the plastic material is more gentle on the wafers.

In order to reduce the wear and optimize the tribological properties, abrasion-reducing and/or wear-reducing additives, for example, PTFE, polyimide, molybdenum disulfide, graphite, boron nitride, nanoparticles or the like, may be added to the plastic material.

Finally, it is also conceivable for the reinforcement materials to be limited to a core area of the retaining ring, in particular, the area in which the fitting elements are then also arranged. This imparts the necessary rigidity and geometrical integrity to the retaining ring, also when one-sided loads occur, while contact between the retaining ring and the wafer will not cause any damage to the wafer as the wafer only comes into contact with the softer plastic materials.

An alternative solution is for the retaining ring to comprise a metal ring embedded in the plastic material and arranged concentrically in the retaining ring. The metal ring then provides the retaining ring with the necessary rigidity and geometrical integrity, while the surrounding plastic material ensures that the semiconductor wafer to be treated will not be subjected to any mechanical damage.

The fitting elements will then preferably be held on the metal ring, so that the fitting elements, which, of course, serve to fit the retaining ring on the polishing apparatus, ensure that the retaining ring will lie exactly on the polishing apparatus, and thereby additionally maintain the geometrical structure of the retaining ring.

The metal ring, which is surrounded by the plastic material, may remain uncovered, in particular, on the upper side, i.e., on the side of the retaining ring facing the polishing apparatus, as there is no provision for contact with the wafer material here. Also, this side of the retaining ring is scarcely or not at all exposed to the chemical agents of the chemical mechanical polishing process.

It is, however, preferable for the metal ring to be completely sheathed by the plastic material, as a larger range of metallic materials is then available for manufacture of the metal ring because the metallic material is completely protected by the plastic material against chemical attack by the agents used in the chemical mechanical polishing.

The simplest form of metal ring for reinforcing the retaining ring is a sheet metal ring. This may, in particular, be perforated or generally provided with through-holes, so that a positive connection is established between the plastic material and the metal ring by the plastic material passing through the through-holes.

As the rigidity of the retaining ring, in particular, in axial direction, is of great importance, a sheet metal ring with a substantially cylindrical shape, i.e., in the form of a cylinder wall, will preferably be used.

Alternatively, ring-shaped disks made of metal may also be used, and a larger thickness of the sheet metal material may then be required.

Each of the components of the invention will now be described in more detail below, wherein like components have like reference numbers.

FIGS. 1A to 1D show an embodiment of a retaining ring 10 according to the invention, which is made of a fiber-reinforced plastic material and has a substantially rectangular cross section. Adjacent the outer circumference 12, the retaining ring 10 has an axially projecting circumferential collar 14 in which threaded bushings 16 are incorporated at regular angular intervals. The threaded bushings 16 serve to attach the retaining ring to the chemical mechanical polishing apparatus.

The side of the retaining ring 10 opposite the collar 14 forms a bearing surface 18 with which the retaining ring 10 rests on a polishing surface of the polishing apparatus when the polishing apparatus is in operation.

Owing to the retaining ring 10 being cost-effectively made of plastic, when the bearing surface 18 is worn the retaining ring 10 as a whole can be disposed of easily, and the problem of reusing parts of the retaining ring 10 is dispensed with.

Figure 1A:
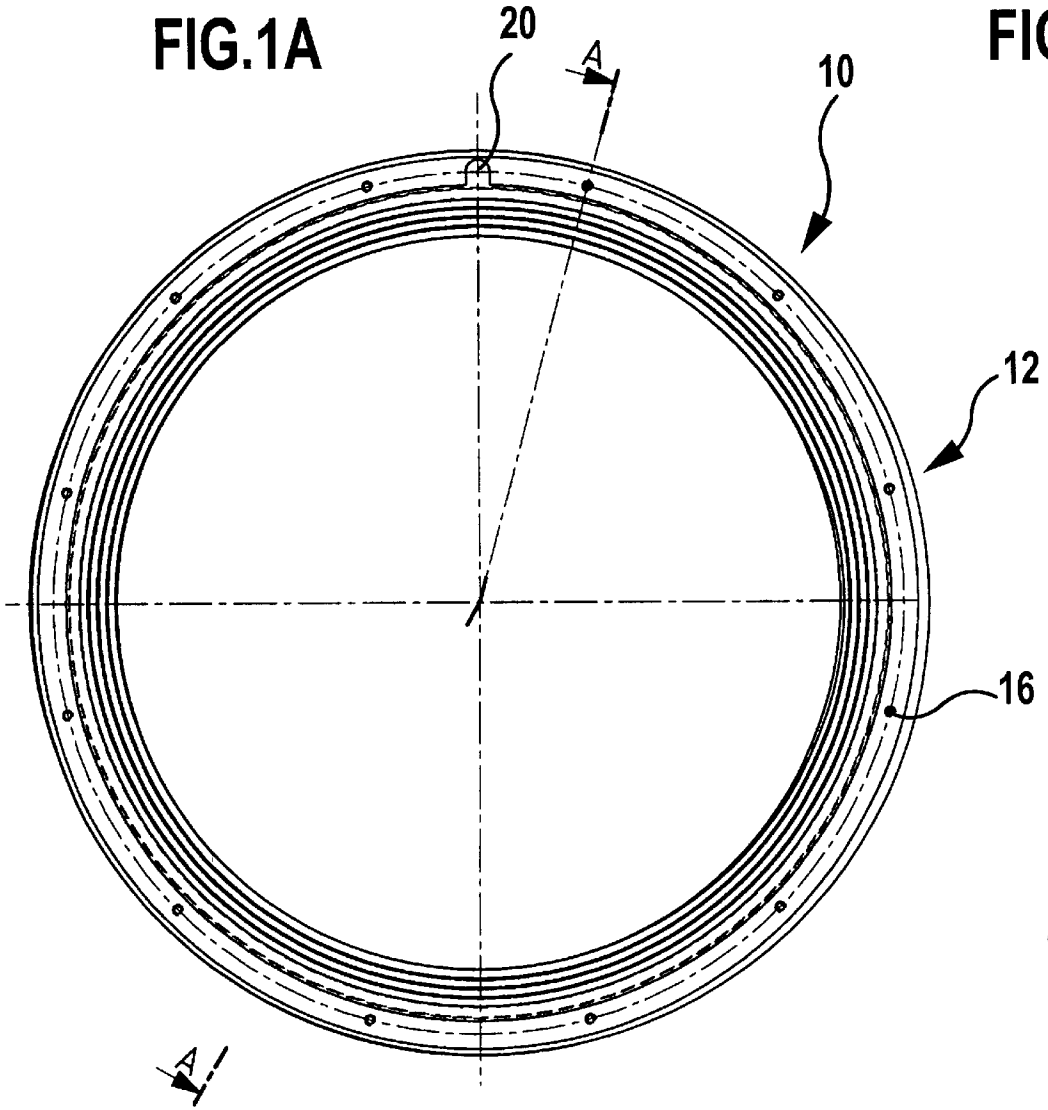
Figure 1C:
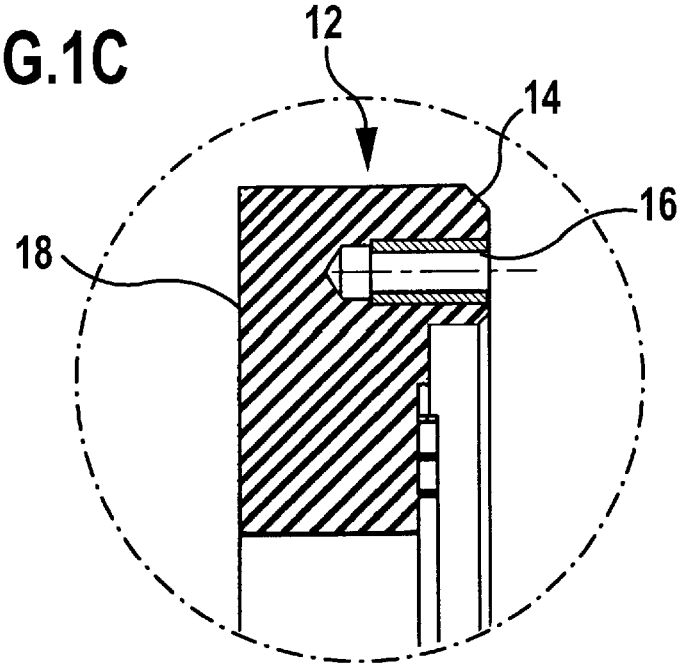
Figure 1D:
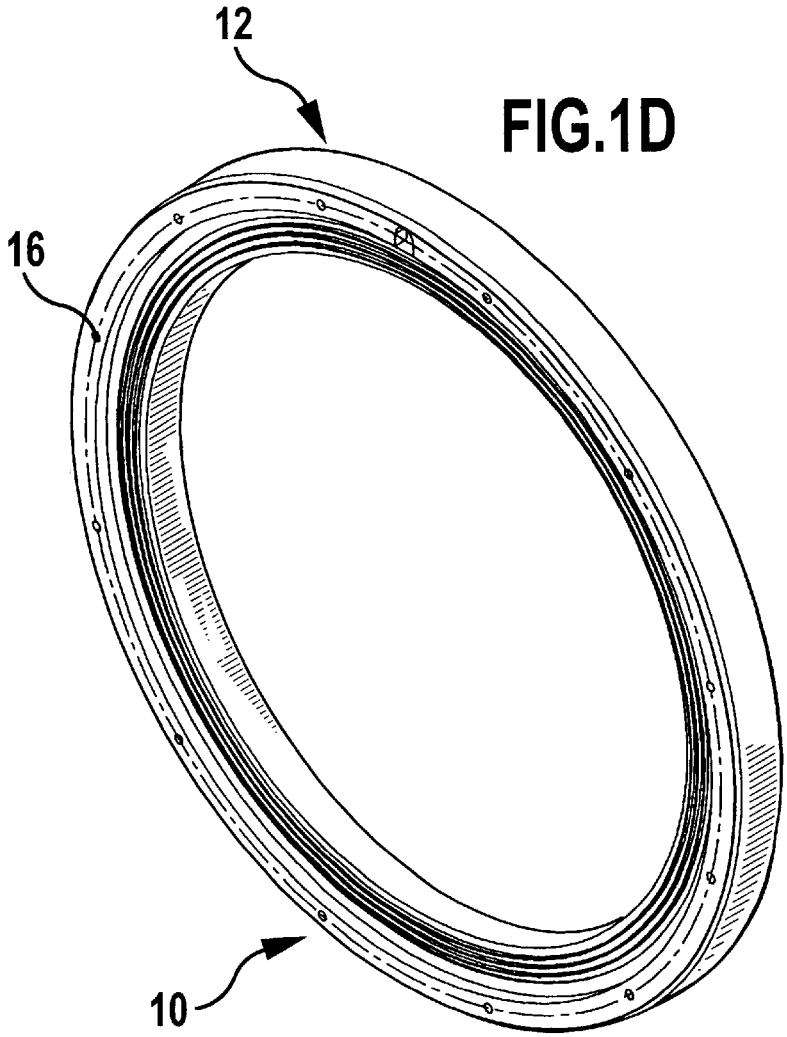
Figure 2B:
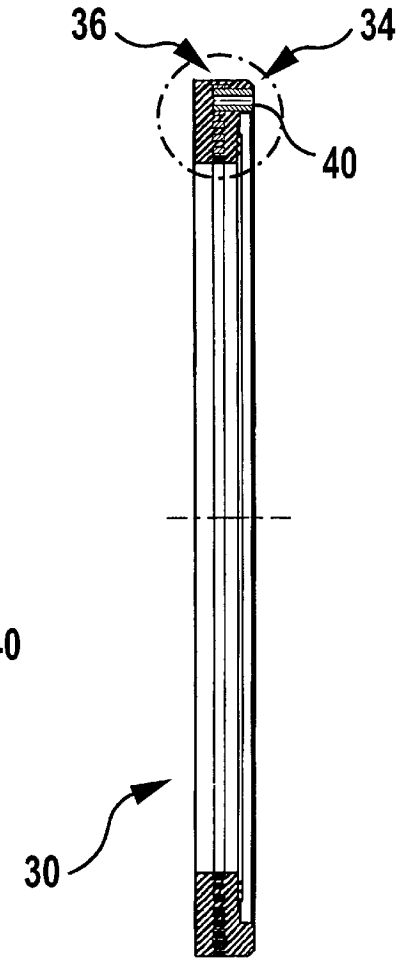
FIGS. 2A to 2D show a second embodiment of a retaining ring according to the invention.
Figure 2A:
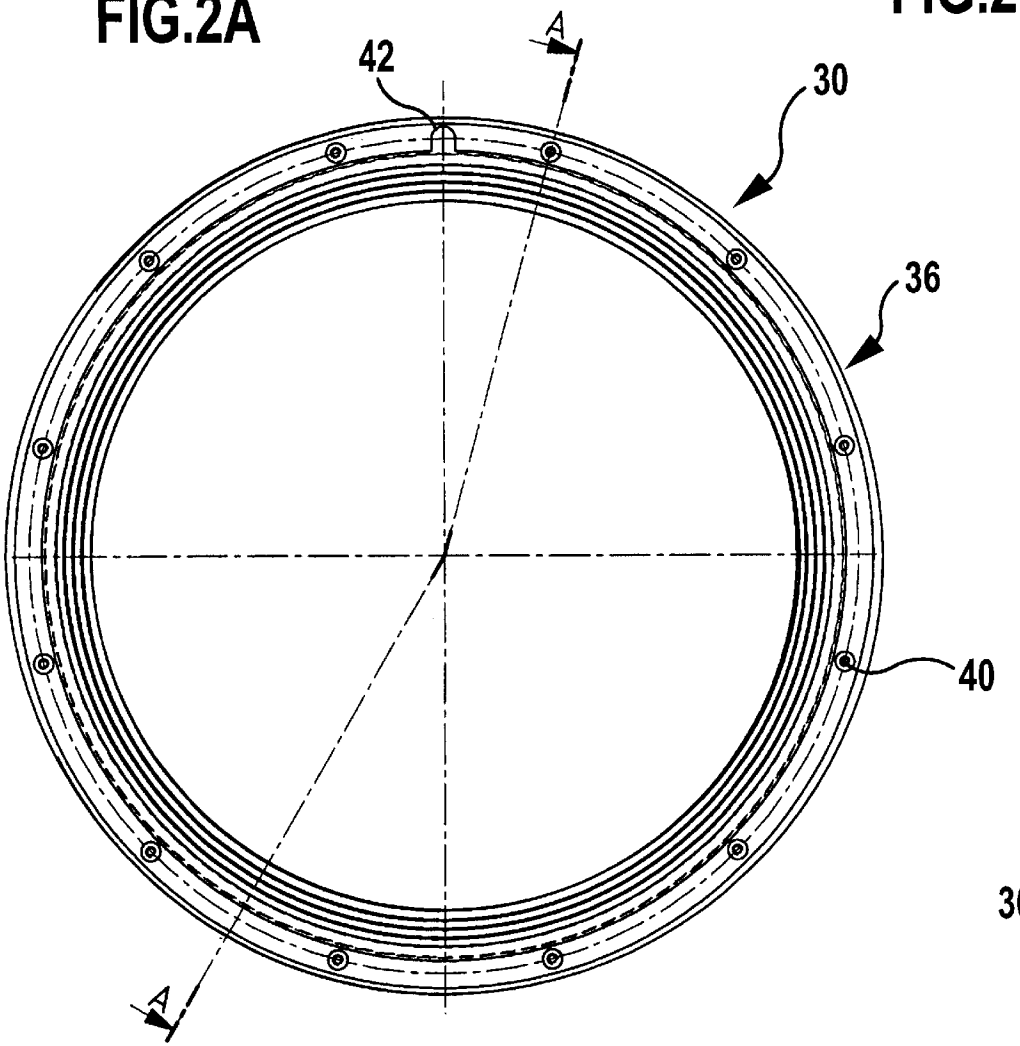
Figure 2C:
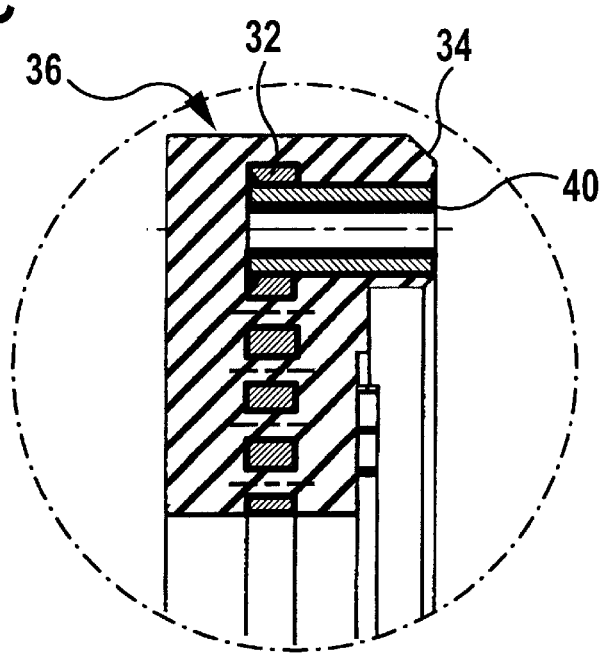
Figure 2D:
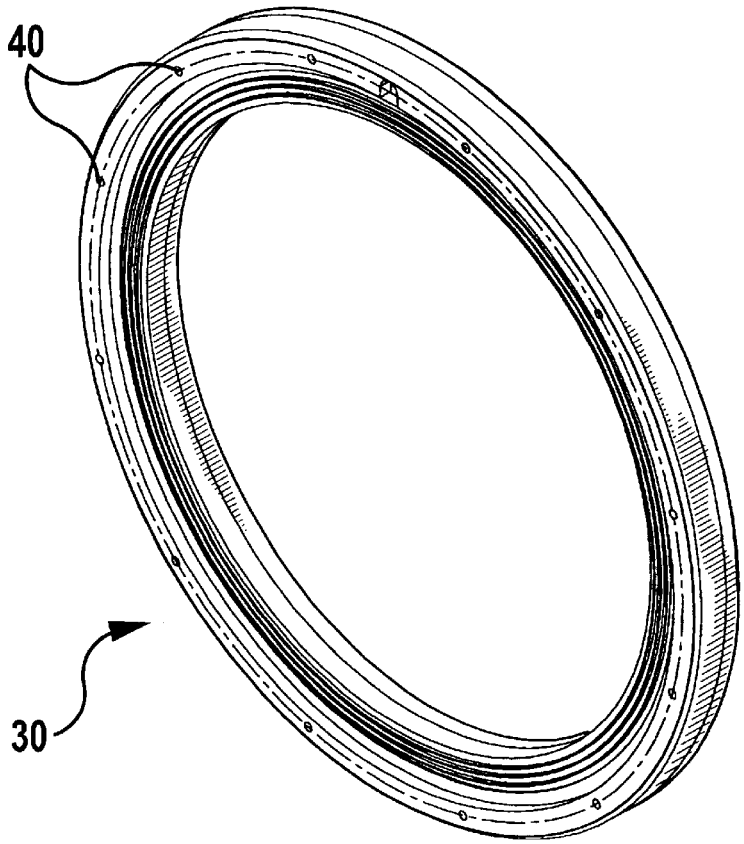

FIG. 1B shows the retaining ring 10 according to an embodiment of the invention taken along line A—A in FIG. 1A. FIG. 1C shows an enlargement of a detail taken from the sectional representation of FIG. 1B. Finally, FIG. 1D again shows a perspective illustration of the retaining ring 10 according to the invention.

The circumferential collar 14 has on its surface pointing towards the polishing apparatus an opening 20 for engagement with a complementary projection on the polishing apparatus in the fitted state, so as to facilitate correct angular orientation of the retaining ring 10 in relation to the polishing apparatus and enable automatic alignment of the threaded bushings 16 with corresponding through-holes on the polishing apparatus, through which screw bolts extend.

Figure 3:
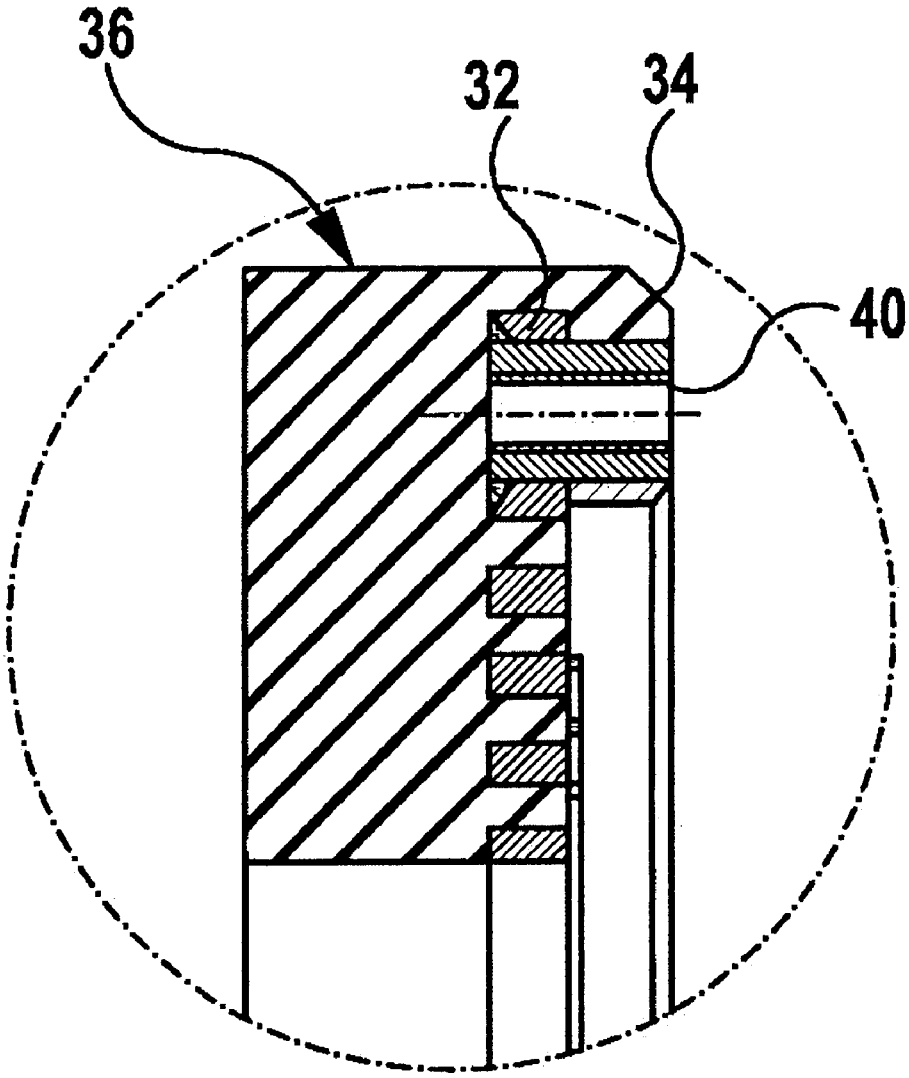
FIG. 3 shows an enlargement of a detail from a sectional representation of another embodiment of a retaining ring according to the invention.

Further embodiments in the form of a retaining ring 30 are shown in FIGS. 2A to 2D, and FIG. 3. The design of the retaining ring 30 differs from the design of the retaining ring 10, in particular, in that a metal ring 32 is embedded in the plastic material as reinforcing element for the plastic material. The metal ring is arranged concentrically with the retaining ring 30 and is made of a perforated sheet material. Therefore, when injecting the plastic material around the metal ring 32, the plastic material will pass through the through-holes of the perforated material and thereby anchor the metal ring 32 with a positive connection in the retaining ring 30. In FIG. 3, the metal ring 32 remains uncovered on the upper side, i.e. on the side of the retaining ring 30 facing the polishing apparatus.

The retaining ring 30 also has on its side facing the polishing apparatus a collar 34 arranged adjacent to the outer circumferential surface 36 of the retaining ring 30 and projecting in axial direction. Threaded bushings 40 for mounting the retaining ring 30 on the polishing apparatus are arranged at regular angular intervals in the area of the collar 34.

To facilitate alignment of the threaded bushings 40 with corresponding screw bolts on the polishing apparatus, the collar 34 has an opening 42 for engagement with a projection on the polishing apparatus, thereby to ensure correct angular assembly of the retaining ring 30.

Owing to the use of a metal ring 32 which is essentially completely surrounded by the plastic material, the plastic material may be selected from a wider spectrum and, in particular, optimally adapted to the requirements for resistance to the abrasion from the polishing surface of the polishing apparatus.

The rigidity of the retaining ring 30 is essentially guaranteed by the stability and the geometrical integrity of the metal ring 32 (annular disk). The metal ring 32 may simultaneously serve to carry the threaded bushings 40, and the metal ring 32 with the threaded bushings 40 can then be placed in a prefabricated state in an injection molding tool and embedded in plastic by injection molding. Owing to the fact that the metal ring 32 is essentially completely surrounded by the plastic material of the retaining ring 30, the metallic material from which the metal ring 32 is made may also be selected from a wide range of materials, as there is scarcely any or no contact at all between the metal ring and the chemical agents used for the chemical mechanical polishing of the semiconductor wafers. There is therefore no need to anticipate corrosion problems.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retaining ring for a chemical mechanical polishing apparatus for semiconductor wafers, comprising:

a retaining ring of integral design made of a plastic material, the retaining ring comprising a metal ring embedded in the plastic material and arranged concentrically in the retaining ring, wherein the retaining ring forms on a first front side thereof a bearing surface for supporting the retaining ring on a polishing surface of the polishing apparatus, and includes on the side thereof lying opposite the first front side thereof in axial direction fitting elements for fitting the retaining ring on the polishing apparatus.

2. The retaining ring according to claim 1, wherein the retaining ring comprises at least two layers.

3. The retaining ring according to claim 2, wherein the plastic material comprises at least one of a thermoplastic material, a thermosetting plastic material, and an elastomer.

4. The retaining ring according to claim 2, wherein the plastic material is a reinforced plastic material.

5. The retaining ring according to claim 4, wherein the plastic material is a fiber-reinforced plastic material.

6. The retaining ring according to claim 5, wherein the plastic material has a lower content of reinforcement substances adjacent to its first front side than on its side including the fitting elements.

7. The retaining ring according to claim 1, wherein the plastic material comprises at least one of a thermoplastic material, a thermosetting plastic material, and an elastomer.

8. The retaining ring according to claim 7, wherein the plastic material is a reinforced plastic material.

9. The retaining ring according to claim 8, wherein the plastic material is a fiber-reinforced plastic material.

10. The retaining ring according to claim 1, wherein the plastic material is a reinforced plastic material.

11. The retaining ring according to claim 10, wherein the plastic material is a fiber-reinforced plastic material.

12. The retaining ring according to claim 10, wherein the plastic material has a lower content of reinforcement substances adjacent to its first front side than on its side including the fitting elements.

13. The retaining ring according to claim 1, wherein abrasion-reducing additives are admixed with the plastic material.

14. The retaining ring according to claim 1, wherein the fitting elements are held on the metal ring.

15. The retaining ring according to claim 1, wherein the metal ring is completely encased by the plastic material.

16. The retaining ring according to claim 1, wherein the metal ring is a sheet metal ring.

17. The retaining ring according to claim 16, wherein the sheet metal ring is a perforated sheet metal ring.

18. The retaining ring according to claim 17, wherein the sheet metal ring has the shape of an annular disk.

19. The retaining ring according to claim 16, wherein the sheet metal ring has a substantially cylindrical shape.

20. The retaining ring according to claim 1, wherein wear-reducing additives are admixed with the plastic material.

21. The retaining ring according to claim 1, wherein abrasion-reducing and wear-reducing additives are admixed with the plastic material.

22. The retaining ring according to claim 1, wherein the metal ring is uncovered by the plastic material on the side of the retaining ring lying opposite the first front side.

* * * * *